US006016417A

United States Patent [19]

Katsuno et al.

[11] Patent Number: 6,016,417

[45] Date of Patent: Jan. 18, 2000

[54] INTERMEDIATE TRANSFER MEDIUM, METHOD FOR PRODUCING THE SAME AND IMAGE FORMING DEVICE USING THE SAME

[75] Inventors: Ryuji Katsuno; Masanori Kobayashi; Tatsuo Okuno; Chikara Ando; Kazuhiko Arai; Yoshihisa Kitano; Nobuhiro Katsuta, all of Nakai-machi; Yasuo Sakaguchi, Minamiashigara, all of Japan

[73] Assignee: Fuji Xerox, Co., Ltd, Tokyo, Japan

[21] Appl. No.: 08/958,250

[22] Filed: Oct. 27, 1997

[30] Foreign Application Priority Data

Nov. 8, 1996 [JP] Japan ..... 8-296837

[51] Int. Cl.[7] ..... G03G 15/14; G03G 15/16

[52] U.S. Cl. ..... 399/308

[58] Field of Search ..... 399/298, 302, 399/307, 308

[56] References Cited

U.S. PATENT DOCUMENTS

| | | | |
|---|---|---|---|
| 2,990,278 | 6/1961 | Carlson | 96/1 |
| 4,453,820 | 6/1984 | Suzuki | 399/308 |
| 5,434,657 | 7/1995 | Berkes et al. | 399/308 |
| 5,519,475 | 5/1996 | Miyamoto et al. | 399/308 |
| 5,530,532 | 6/1996 | Iino et al. | 399/308 X |

FOREIGN PATENT DOCUMENTS

| | | |
|---|---|---|
| 46-41679 | 12/1971 | Japan . |
| 59-50473 | 3/1984 | Japan . |
| 59-202477 | 11/1984 | Japan . |
| 2-108072 | 4/1990 | Japan . |
| 5-19642 | 1/1993 | Japan . |
| 5-107950 | 4/1993 | Japan . |
| 5-249798 | 9/1993 | Japan . |
| 5-333711 | 12/1993 | Japan . |
| 6-102782 | 4/1994 | Japan . |
| 7-43992 | 2/1995 | Japan . |
| 8-185061 | 7/1996 | Japan . |

*Primary Examiner*—Fred L Braun
*Attorney, Agent, or Firm*—Oliff & Berridge, PLC

[57] ABSTRACT

An intermediate transfer medium and the like for image formation includes transferring and fixing a toner image from a photoreceptor onto a recording medium such as paper by using the intermediate transfer medium. The intermediate transfer medium can yield a high gloss desirable for color image and the control of the driving run of the intermediate transfer medium can be maintained readily by reducing the frictional coefficient with the photoreceptor and the intermediate transfer medium can reduce the fog toner transfer rate to prevent the deterioration of the resulting image quality. The surface of the intermediate transfer medium where the image is primarily transferred (primary image transfer medium) is of smooth surface with protrusions dispersed thereon in a manner such that the smooth surface and the protrusions might be discriminated from each other. The relation between the area ratio of the smooth surface on the primary image transfer surface [Cin %] and the height of the protrusions [h ($\mu$m)] preferably satisfies the following experimental formula (1):

$$h \leqq 19 \cdot (1-\mathrm{Cin}/100)^{-1/2} - 24.5 \quad (1)$$

12 Claims, 13 Drawing Sheets

INTERMEDIATE TRANSFER MEDIUM, METHOD FOR PRODUCING THE SAME AND IMAGE FORMING DEVICE USING THE SAME

BACKGROUND OF THE INVENTION

1. Field of the Invention

The present invention relates to an intermediate transfer medium and an image forming device, both to be utilized for an image forming method utilizing a process comprising primarily transferring a toner image formed on a photoreceptor onto the intermediate transfer medium and transferring and fixing the primarily transferred toner image on recording paper, and a method for producing the intermediate transfer medium.

2. Description of the Background Art

The imaging technique comprising forming an electrostatic latent image on a photoreceptor, developing the image as a toner image by means of dry toner, and thereafter transferring and fixing in an electrostatic manner the toner image on a recording medium has been used conventionally in a wide variety of fields, but the technique is disadvantageous in that the resulting image is uneven from the respect of density or powder toner is dispersed on the transfer part, with the resulting deterioration of resolution and dot reproducibility.

The reason principally lies in the process of transferring in an electrostatic manner the toner image on the photoreceptor onto a recording medium.

Because the transfer efficiency of a toner layer depends on Et, the efficiency varies depending on the thickness of the toner layer and the transfer position on a recording medium, unless Et is maintained constant irrespective of the recesses and protrusions of the recording medium representatively illustrated by paper and the electrical properties thereof. When the toner image formed on the photoreceptor is of a monochromatic layer of a thin thickness, the unevenness in the resulting image is principally induced by the recesses and protrusions of the recording medium and the electrical properties thereof. This is the case when monochromatic toner images individually formed on a plurality of photoreceptors are overlaid and transferred onto a single recording medium to form a color image, and therefore, the recesses and protrusions of a recording medium and the electrical properties thereof cause unevenness in the resulting image. In other words, the difference between overlaying and transferring parts and monochromatic transfer parts without overlaying or transferring can be suppressed in an electrostatic manner, but it is difficult to supplement the recesses and protrusions of the recording medium or the unevenness of the electrical properties thereof.

Alternatively, an electrostatic transfer process has been known, comprising overlaying and transferring monochromatic toner images individually formed on a plurality of photoreceptors onto an intermediate transfer medium under controls of the properties without recess or protrusion, so-called intermediate transfer medium (for example, belt and drum), and thereafter transferring the resulting color image on a recording medium. In this case, a uniform image without unevenness can be formed on the intermediate transfer medium. However, the toner images on the intermediate transfer medium are of multiple layers, namely three layers or more at parts with abundant layers and one layer or less at parts with lesser layers, and therefore, it is difficult to load a constant electric field onto these toner layers so as to integrally transfer the layers uniformly in an electrostatic manner onto a recording medium representatively illustrated by paper. Consequently, the resulting Et is non-uniform. By such electrostatic transfer process, thus, not the whole toner image color overlaid on the intermediate transfer medium is transferred, but the image may partially remain on the intermediate transfer medium. Additionally, the extent of the image left thereon varies depending on the thickness of the toner layers formed on the intermediate transfer medium. Therefore, the resulting color image on the recording medium loses color balance, so that a desired color image cannot be recovered. Additionally, recording media such as paper cannot closely adhere to the intermediate transfer medium due to the presence of the recesses and protrusions on the surface thereof, involving the occurrence of non-uniform gaps, which causes the disorder of the transfer electric field or the coulomb repulsion of the toner powder from each other to disperse the toner powder. Then, the quality of the resulting image is deteriorated.

For the countermeasure against the problem, Japanese Published Examined Patent Application No. Sho 46-41679 discloses a method comprising adhesion transferring a toner image formed on a photoreceptor onto an intermediate transfer medium and subsequently thermally transferring the toner from the intermediate transfer medium onto a recording medium. Because the transfer of the toner image onto the recording medium progresses in a non-electrostatic manner by the method, the deterioration of the image quality at the electrostatic transfer process as described above hardly occurs.

Furthermore, Japanese Unexamined Patent Application No. Hei 2-108072 discloses a technique comprising overlaying and transferring toner images of different colors onto an intermediate transfer medium, fusing the multiple toner images of multiple colors on the intermediate transfer medium and transferring the fused multiple toner images onto a recording medium. Because the transfer of the toner images onto the recording medium progresses in a non-electrostatic manner by the method, the deterioration of the image quality as described above hardly occurs (the method is called "transfer fixing method" hereinafter).

As to the image forming device utilizing the transfer fixing method, U.S. Pat No. 2,990,278, Japanese Published Unexamined Patent Application No. Hei 5-19642, Japanese Published Unexamined Patent Application No. Hei 5-107950 and Japanese Patent Laid-open No. Hei 5-249798 disclose a technique comprising keeping an intermediate transfer medium and a recording medium closely together for heating and pressing, so as to completely transfer the toner image from the intermediate transfer medium to the recording medium, cooling the toner image until the cohesion potency of the toner is above the adhesion potency between the toner and the intermediate transfer medium (at least below the melting point of the toner), and peeling off the recording medium from the intermediate transfer medium. According to the technique, an image of high quality including high toner transfer efficiency, good color balance, high gloss and good toner transparency, can be generated. So as to effectively utilize the advantages, subsequently, research works have been made regarding the composition of the uppermost layer of such intermediate transfer medium, in particular.

For example, investigations have been made about silicone rubber, fluorine resins or fluorine resins dispersed in fluorine rubber, as materials with thermal resistance and toner peelability.

Unlike conventional fixing devices, devices utilizing an intermediate transfer medium cannot feed releasing agents such as silicone oil onto the surface of the intermediate transfer medium because the intermediate transfer medium is in contact to the surface of a photoreceptor. For the purpose of preventing the offset phenomenon of a toner image on the surface of an intermediate transfer medium during transfer and fixing to reduce the defects of the resulting image, therefore, silicone rubber with advantages such as good releasability from toner is frequently used as a surface material of such intermediate transfer medium.

However, the following problems occur even when an intermediate transfer medium coated with silicone rubber is used.

On the surface of a photoreceptor are present a great number of toners called as fog toners, other than toner images forming an image. For directly transferring toner images on the surface of a photoreceptor on a recording medium by utilizing electrostatic power, fog toners are selectively transferred by utilizing electrostatic power, so the image of the fog toners is at a non-detectable level on the recording medium even if transferred thereon. However, almost all of the fog toners are transferred on the surface of the aforementioned intermediate transfer medium, if it is used, because of the elasticity and adhesiveness of the silicone rubber. Consequently, the resulting image quality is essentially deteriorated, disadvantageously.

When toner images once melt are cooled below the melting point of toner and are then released, the toner images released from the surface of the intermediate transfer medium follow the surface profile of the intermediate transfer medium on the recording medium, although no offset phenomenon onto the surface of the intermediate transfer medium may occur. More specifically, the surface of the toner images approximately follows the surface profile of the intermediate transfer medium as if by molding, characteristically; if the surface of the intermediate transfer medium is smooth, the toner images are so glossy, namely with a higher gloss, while the toner images are at a lower gloss if the surface of the intermediate transfer medium is rough or foggy. Therefore, the surface of silicone rubber should essentially be maintained at a smooth state if a higher gloss is required. This is readily attained because silicone rubber has greater leveling property. However, another problem occurs in such case. In other words, the following problem occurs, concerning the fact that because toner images of three colors or more should be overlaid together for development so as to copy and print a color image, the shift of individual registrations, namely positional shift, is of great significance on image quality.

Intermediate transfer mediums of smooth surface, such as mediums coated with silicone rubber, have higher frictional coefficients with very smooth surface of photoreceptors and the like. Consequently, slipping occurs between the driving part (for example, driving roll) of the intermediate transfer medium and the back face of the intermediate transfer medium. When the frictional coefficient between the driving roll and the back face of the intermediate transfer medium is raised to increase the driving force, the intermediate transfer medium waves or cannot retain its planar surface because the direction of the force supplied from the driving roll does not strictly agree with the direction of the force supplied from the photoreceptor, generally due to mechanical precision, and these powers work to pull the intermediate transfer medium together. No problem occurs when these directions agree with each other. Consequently, the toner images on the surface of the photoreceptor cannot be transferred accurately, disadvantageously involving the occurrence of image defects.

So as to reduce the frictional coefficient of rubber, generally, a method comprising roughing the surface is used. A number of such methods have been known. One of the methods comprises roughing the surface through spray coating under conditions hardly fogging silicone rubber in the spray, for example, by modifying coating conditions such as temperature, moisture and the distance from a spray gun and by modifying the viscosity of silicone rubber. By the method, however, fine undulations can be made but the surface thereof remains smooth, so the frictional coefficient of the rubber cannot be reduced so much. Another method comprises a blast process of blasting sand or steel particles, which roughs the overall rubber surface by preparing recess parts on the surface. However, the frictional coefficient is only slightly decreased, or the transfer rate of the fog toner cannot be reduced. The gloss of the resulting image is severely reduced, and additionally, the rubber can be roughed uniformly with much difficulty, which causes the surface uneven. Hence, the resulting image quality is severely deteriorated. Blade coaters and dipping can be used as other coating means, but both means make the surface like mirror face even though these means can generate greater undulations. Accordingly, the problems to be overcome and focused by the present inventors can never be solved.

Some of prior art include the description about the surface roughness of intermediate transfer mediums. Japanese Published Unexamined Patent Application No. Sho 59-50473 describes that the surface roughness can be controlled by spray coating, but according to the description, the frictional coefficient of the surface with a photoreceptor cannot be reduced enough to control and slide the intermediate transfer medium on the photoreceptor or at such a level that not any transferred fog toner is detectable. Besides, Japanese Published Unexamined Patent Application Nos. Sho 59-202477, Hei 5-19642, Hei 5-333711, Hei 6-102782, Hei 7-43992, and Hei 8-185061 of the prior art only define the surface roughness of intermediate transfer mediums, for the purpose of improving the durability of the rubber on the surface of the intermediate transfer mediums, the transferability thereof, and image gloss, preventing transfer error, and improving the adhesiveness with transferring materials, for the purpose of preventing toner offset on the surface of intermediate transfer mediums, and for the purpose of improving the shelf life of releasing agents so as to prevent the adverse effects of the releasing agents such as oil. Even if the surface roughness as disclosed in these publications is attained, not all of the following requirements can be satisfied; high gloss desirable for color images with no observable effect of the recesses and protrusions on the surface of the intermediate transfer mediums on the images; good control of driving run of the intermediate transfer mediums for preventing image shift (namely, low frictional coefficient with photoreceptors) and reduction of the transfer rate of fog toner.

SUMMARY OF THE INVENTION

Taking account of the drawbacks described above, thus, it is a first object of the present invention to provide an intermediate transfer medium with the surface made of silicone rubber and the like for an image forming device for transferring and fixing a toner image from a photoreceptor onto a recording medium, wherein the image gloss can reach a high level desirable for color image and the frictional coefficient with the photoreceptor is reduced to make the control of the driving run of the intermediate transfer medium easier and the transfer rate of fog toner is reduced to prevent the deterioration of the resulting image.

It is a second object of the present invention to provide a method for producing the intermediate transfer medium.

It is a third object of the present invention to provide an image forming device utilizing the intermediate transfer medium.

The first object of the present invention can be attained by the following intermediate transfer medium. More specifically, the intermediate transfer medium is used for an imaging method comprising developing a photoreceptor with an electrostatic latent image formed thereon in a developer containing toner, primarily transferring the developed toner image onto the intermediate transfer medium, and thereafter bringing the primarily transferred toner image into contact with a recording medium to transfer the toner image onto the recording medium at least by heating, wherein the surface with the image primarily transferred thereon (also referred to as "primary image transfer surface" hereinafter) is of smooth surface with protrusions dispersed thereon in a manner such that they (smooth surface and the protrusions) might be discriminated from each other.

In accordance with the present invention, the phrase "smooth surface and protrusions might be discriminated from each other" means that smooth surface is objectively distinguishable from protrusions on an enlarged view or an enlarged photograph of the primary image transfer surface under observation (in other words, a person with ordinary skill in the art can substantially correctly identify the presence of the two types). The characteristic property should be observed in any of the regions under observation. Therefore, the primary image transfer surface in accordance with the present invention is obviously different from surface where recess and protrusion can be discriminated from each other but smooth surface is not apparent, namely sand blasted surface.

In accordance with the present invention, the individual protrusions present on the primary image transfer surface are dispersed, so the image transferred from the surface onto a recording medium can acquire high gloss with less influence of the protrusions (in other words, the recesses on the image after transferring, which correspond to the protrusions, are not any more visual) On the other hand, the protrusions make the friction between the intermediate transfer medium and the photoreceptor smaller and additionally, the protrusions can prevent the transfer of fog toner. Thus, the above object can be attained.

Through the same or similar actions, the first object can also achieve the following inventions;

an intermediate transfer medium to be used for the imaging method, wherein the surface with the image transferred thereon comprises smooth surface and protrusions dispersed thereon in a manner such that the smooth surface and the protrusions might be discriminated from each other and the relation of the area ratio of the smooth surface on the whole surface of the intermediate transfer medium [Cin %] and the height of the protrusions [h ($\mu$m)] satisfies the following experimental formula (1):

$$h \leqq 19 \times (1 - \mathrm{Cin}/100)^{-1/2} - 24.5 \quad (1);$$

the height of the protrusions being 2 $\mu$m or more. Cin is for example 50 to 95%;

an intermediate transfer medium to be used for the imaging method, wherein the surface with the image transferred thereon comprises smooth surface and protrusions dispersed thereon in a manner such that the smooth surface and protrusions might be discriminated from each other and the primary image transfer surface has a smaller frictional coefficient, due to the presence of the protrusions, than the frictional coefficient of such surface but with no presence of such protrusions.

The second object of the present invention can be attained by the method for producing the intermediate transfer medium, comprising a process of pressing a mold with a face corresponding to the surface with the image primarily transferred thereon against the surface of the intermediate transfer medium, prior to final curing.

The third object of the present invention can be attained by an image forming device at least comprising a photoreceptor, developing units to supply a developer containing toner to the photoreceptor, an intermediate transfer medium brought into contact with the photoreceptor, recording medium transfer means to transfer a recording medium to the intermediate transfer medium to bring the medium into contact with the intermediate transfer medium, and heating means to heat the contact part, the image forming device being capable of practicing an image forming method comprising the steps of forming an electrostatic latent image on the photoreceptor by utilizing light, developing the electrostatic latent image in a developer containing toner, primarily transferring the developed toner image on the intermediate transfer medium, subsequently bringing the primarily transferred toner image into contact with the recording medium, and transferring the toner image onto the recording medium at least by heating, the image forming device comprising the surface of the intermediate transfer medium, on which the image is primarily transferred, being a smooth surface and protrusions dispersed thereon in a manner such that the smooth surface and the protrusions might be discriminated from each other.

DESCRIPTION OF THE PREFERRED EMBODIMENTS

The present invention will now be described hereinafter in detail.

Figure 1:
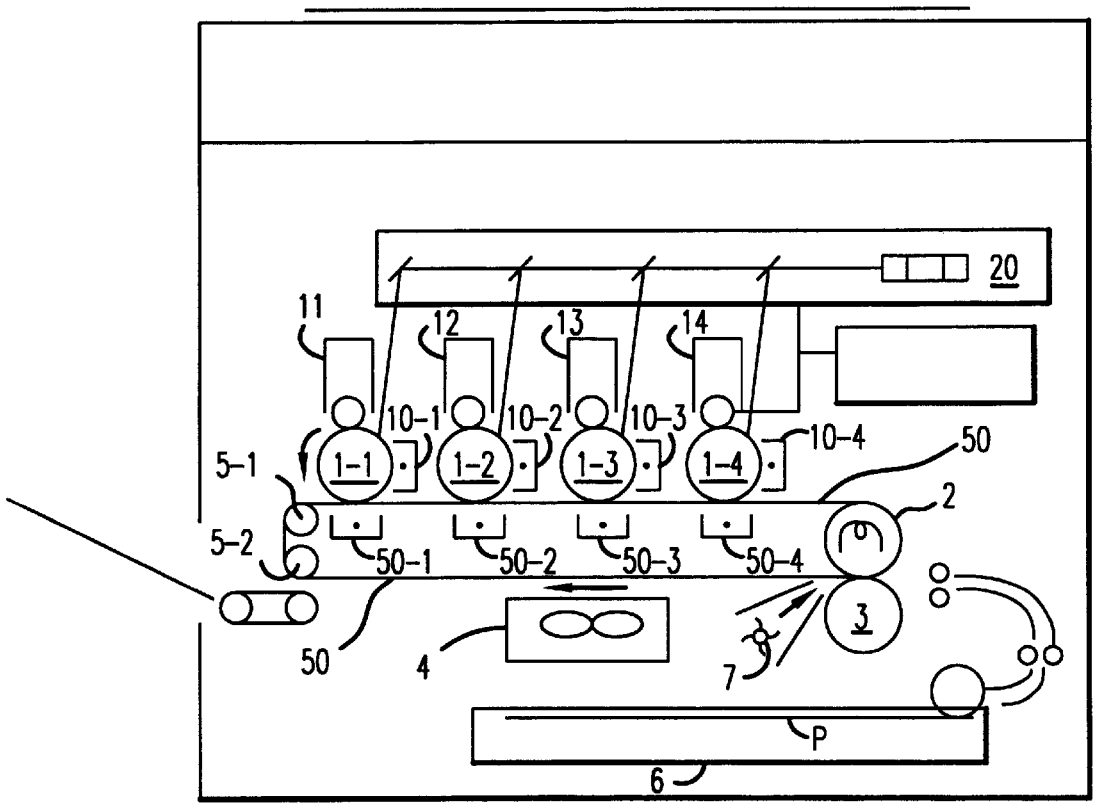
FIG. 1 is a schematic view depicting one example of the image forming device using the intermediate transfer medium in accordance with the present invention.

FIG. 1 is a schematic explanatory view depicting one example of the present invention, wherein the intermediate transfer medium of the present invention and an image forming device utilizing the intermediate transfer medium are schematically shown.

Intermediate transfer medium 50 is of a belt shape, comprising a two-layer structure of a base layer and a surface layer.

Materials to be used as the base layer (base material) of the intermediate transfer medium include polyimide, polyether ether ketone (PEEK), polyarylene sulfide (PAS), polyimide amide, polyether sulfone (PES), polyether nitrile (PEN), and thermoplastic polyimide. Preference is given to polyimide, from the respect of the requirements of thermal resistance and mechanical strength.

So as to transfer a toner image from the photoreceptor to the intermediate transfer medium with no occurrence of electrostatic disorder of the image, additionally, the volume resistivity of the surface layer is preferably $10^{12}$ Ωcm to $10^{15}$ Ωcm.

For simultaneous transfer and fixing of a toner image from the intermediate transfer medium to a recording medium, preferably, the surface layer is a coating layer of silicone rubber, so as to improve the adhesion through the toner image between the intermediate transfer medium and the recording medium in terms of the releasability and thermal resistance of the toner. In some case, however, a coating layer of fluorine resin and a coating layer of a fluorine resin dispersed in fluorine rubber may be used as the surface layer. Generally, the rubber hardness of the surface layer is 20 to 70 degrees; the thickness thereof is 20 to 300 μm.

In FIG. 1, the individual intermediate transfer mediums 50, 50 in a belt form are arranged separately in the horizontal direction of two rollers 5-1 and 5-2 arranged over and below the transfer mediums, and are additionally supported in a rotary manner in the arrow direction by heating roll 2 with a diameter substantially equal to the distance between the top and bottom points of the two rollers 5-1 and 5-2. Pressing roll 3 is arranged opposite to the heating roll 2 while interposing the intermediate transfer mediums. As the heating and pressing rolls, use is made of a simple metal roll or a metal roll with a thermally resistant elastic layer of silicone rubber. A heating source is arranged inside the heating roll, and the heating temperature of the heating source is under controls so that the toner temperature in the heating region might be above the melt temperature of the toner. The heating roll 2 and the pressing roll 3 may be arranged adversely; furthermore, the pressing roll 3 may be in the form of a heating roll with a heating source inside.

Drum-type photoreceptors 1-1, 1-2, 1-3 and 1-4 are arranged in parallel, in contact to the surface of the upper moving face of the intermediate transfer medium 50 and opposite to the surface thereof, along the belt moving direction, and these drum-type photoreceptors can be uniformly charged individually by independently arranged chargers 10-1, 10-2, 10-3 and 10-4. As the photoreceptors 1-1, 1-2, 1-3 and 1-4, use is made of a variety of organic photoreceptors in addition to a variety of inorganic photoreceptors (Se, a-Si, a-SiC, CdS, etc.).

Optical beam scanning device 20 for switching on or off the individual photoreceptors by an optical beam pulse width modulation device, depending on the density signal, is arranged independently for each photoreceptor. On each photoreceptor are arranged developing units 11, 12, 13 and 14, containing toners of black, yellow, magenta and cyan colors, respectively. The color toners comprise thermoplastic binders containing pigments of yellow, magenta, cyan and the like, and known materials are used for the color toners. Additionally, the exposure conditions and developing conditions are predetermined so that each color toner is at about 0.4 mg/cm$^2$ to 0.7 mg/cm$^2$ on a recording medium, depending on the content of each pigment in the toner.

Below the individual photoreceptors 1-1, 1-2, 1-3 and 1-4 are arranged transfer units 50-1, 50-2, 50-3 and 50-4, respectively, while interposing the intermediate transfer medium 50.

Recording paper P is transferred from tray 6 in between the pressing (heating) roll 2 and the pressing roll 3.

The recording paper supporting part (nip part) of the pressing roll 2 and the pressing roll 3, namely heating region, is arranged so that the intermediate transfer medium 50, the toner image and the recording paper P might adhere together sufficiently closely in the heating region, without partial floating or with no occurrence of wrinkles or shift of the recording medium. Appropriately, the nip pressure is within a range of $1\times10^5$ Pa to $1\times10^6$ Pa.

A heating region outlet cooling unit 7 is arranged just behind the heating region, in a fashion to face the recording paper P. The heating region outlet cooling unit 7 is for the purpose of decreasing the toner temperature immediately after the paper passes through the heating region, and the same effect may be brought about when the part just behind the heating region is cooled not only from the side of the paper but also from the side of the intermediate transfer medium. The same is true when the part just behind the heating region is cooled from both the sides. Through cooling, the toner cohesion is elevated to prevent the toner offset onto the intermediate transfer medium 50 during peeling.

A cooling unit 4 arranged below the lower moving face of the intermediate transfer medium cools the intermediate transfer medium 50 and the recording paper P, integrally transferred from the heating region.

The system of the aforementioned composition functions as follows.

Each photoreceptor is exposed to the optical beam scanner 20, depending on the image signal, to form an electrostatic latent image. The electrostatic latent images on the individual photoreceptors are developed with developing units 11, 12, 13 and 14, containing black, yellow, magenta and cyan colors, respectively, to form toner images of individual colors, as so-called digital image representing density through area modulation. The toner images of individual colors are primarily transferred sequentially through transfer devices 50-1, 50-2, 50-3 and 50-4, onto the intermediate transfer medium 50, to form a toner image of multiple colors on the intermediate transfer medium 50.

As the recording paper P is transferred from the tray 6, the pressing roll 3 is pressed against the heating roll 2. Subsequently, the intermediate transfer medium 50 retaining the toner image of multiple colors is transferred together with the recording paper P just in timing between the heating roll 2 and the pressing roll 3, for heating and pressing. The toner heated above the melt temperature thereof is softened and melt to infiltrate into the recording paper P to be then solidified. Thus, transfer and fixing is on completion.

The intermediate transfer medium 50 and the recording paper P, both cooled at the heating region outlet cooling unit 7 and the cooling unit 4, are transferred to roll 5-2 with a smaller radius of curvature, where owing to the curve of the recording paper P, the recording paper is separated together with the toner from the intermediate transfer medium 50, to form a color image. Like the surface of the intermediate transfer medium 50, the surface of the toner image transferred and fixed on the recording paper P is smoothed out to acquire a high gloss.

The primary image transfer surface of the intermediate transfer medium to be used for the image forming device in accordance with the present invention is of smooth surface with protrusions dispersed thereon. The intermediate transfer medium is defined by the combination of the requirements in the following description.

The protrusions are dispersed in a distinguishably dispersed manner on the smooth surface of the primary image transfer surface. Due to the presence of such protrusions, furthermore, the primary image transfer surface has a smaller frictional coefficient than the frictional coefficient of such surface but with no protrusion present thereon.

The height of the protrusions is preferably 2 $\mu$m or more to 12 $\mu$m or less, more preferably 3 $\mu$m or more to 9 $\mu$m or less.

The interval between the protrusions is preferably 10 $\mu$m or more to 200 $\mu$m or less.

Furthermore, the relation between the area ratio of the smooth surface on the whole surface of the intermediate transfer medium [Cin %] and the height of the protrusions [h ($\mu$m)] preferably satisfies the following experimental formula (1):

$$h \leqq 19 \times (1 - \mathrm{Cin}/100)^{-1/2} - 24.5 \quad (1);$$

(see the examples described below.)

The shape of each of the protrusions and the pattern of arranging the protrusions are with no specific limitation; irrespective of the presence or absence of order, a variety of patterns may be available, but for example, patterns shown in FIGS. 2 to 7 are illustrated.

Figure 2:
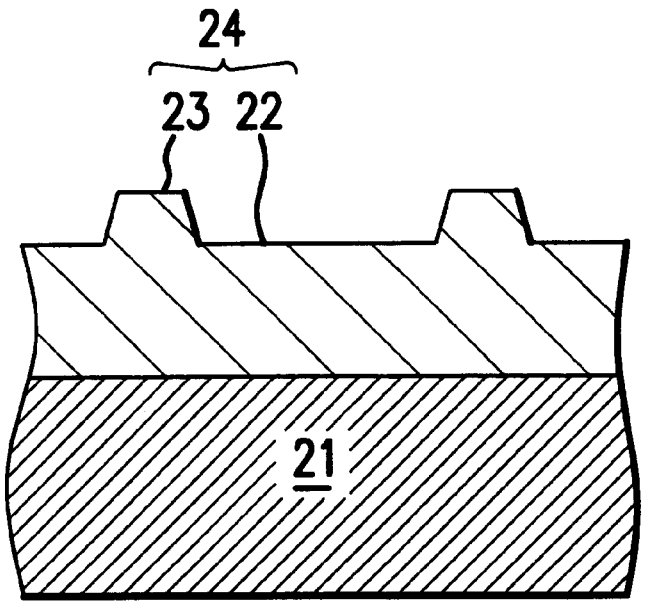
FIG. 2 is a schematic cross sectional view of one example of the intermediate transfer medium of the present invention.
Figure 3:
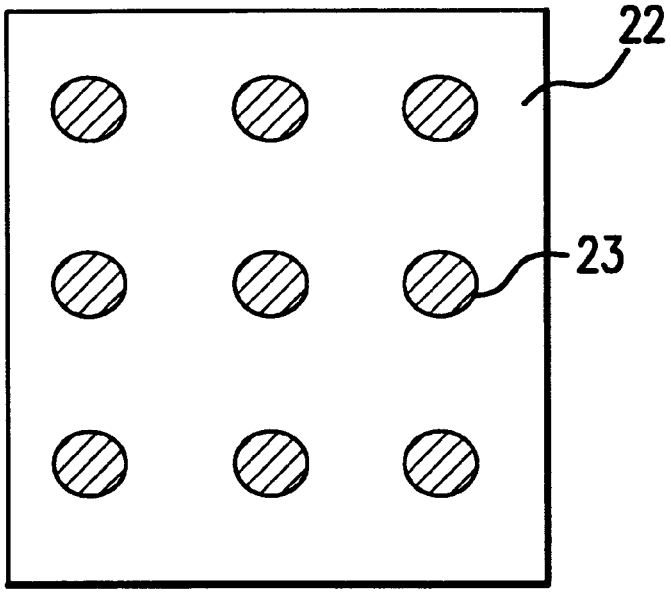
FIG. 3 is a schematic plane view depicting one example of the intermediate transfer medium of the present invention.
Figure 4:
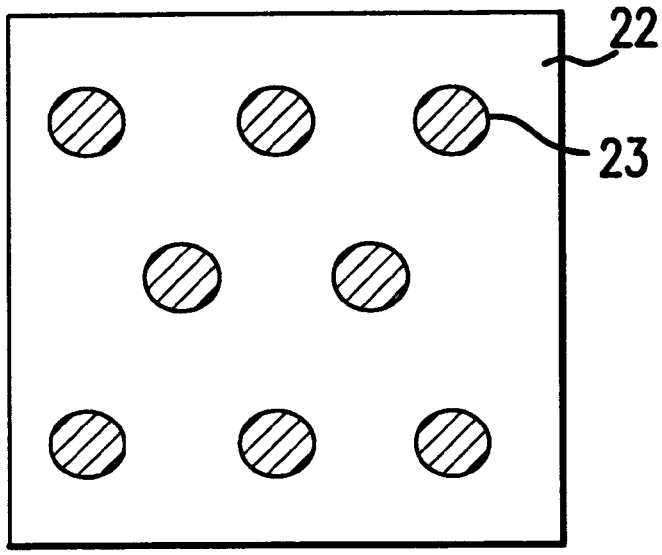
FIG. 4 is a schematic plane view depicting another example of the intermediate transfer medium of the present invention.
Figure 5:
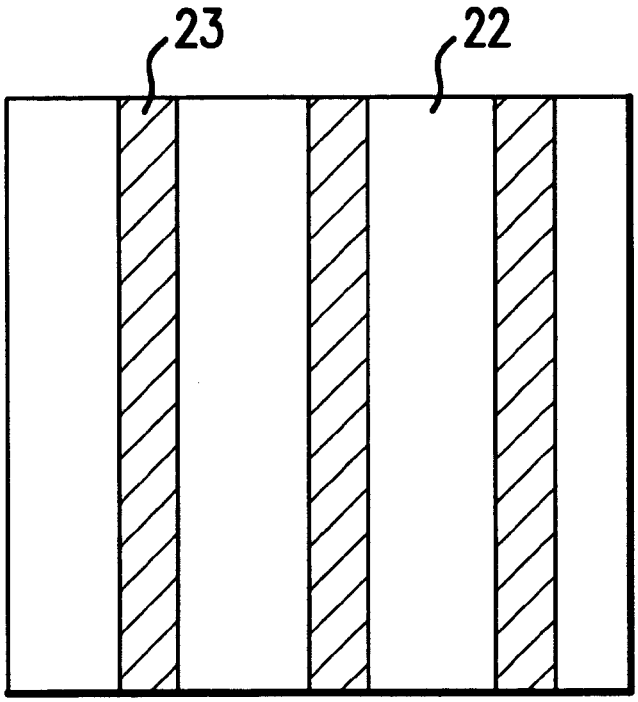
FIG. 5 is a schematic plane view depicting still another example of the intermediate transfer medium of the present invention.
Figure 6:
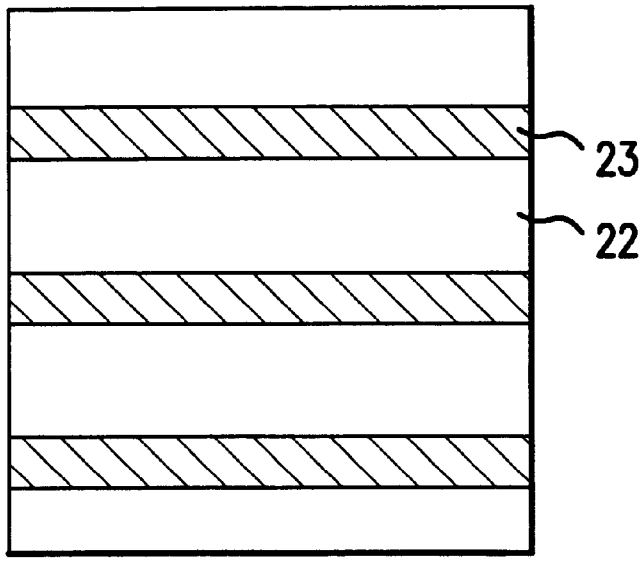
FIG. 6 is a schematic plane view depicting a further more example of the intermediate transfer medium of the present invention.
Figure 7:
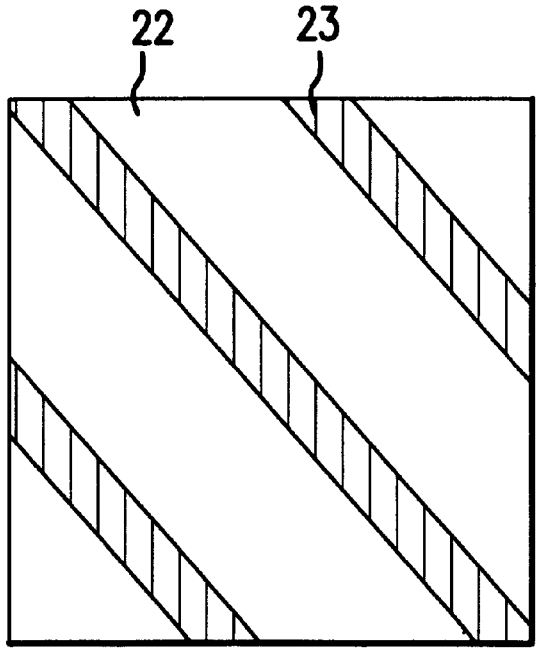
FIG. 7 is a schematic plane view depicting a still further example of the intermediate transfer medium of the present invention.

FIG. 2 is a cross sectional view of the intermediate transfer medium, where silicone rubber 24 with smooth part 22 and protrusions 23 is arranged on base layer 21. Additionally, FIGS. 3 to 7 are overviews of the patterns of the protrusions. As shown in FIG. 3 or 4, the protrusions are separated (FIG. 3 shows a pattern of protrusions aligned in the same fashion in each line and each row; FIG. 4 shows a pattern of protrusions aligned in the same manner every two lines); as shown in FIGS. 5 to 7, the pattern may be in a line (FIG. 5 shows a pattern of protrusions in a vertical line along the longitudinal direction of the intermediate transfer medium; FIG. 6 shows a pattern thereof in a parallel line along the direction; and FIG. 7 shows a pattern thereof in an oblique line along the direction.)

Preferably, the protrusions may be of an equal height, but it is not essentially required.

So as to produce the intermediate transfer medium of the present invention, any appropriate method may be utilized, including for example embossing. For example, a mold produced by forming micro recesses on the fine smooth surface of a metal may satisfactorily be used, but the following method may preferably be utilized.

Figure 8:
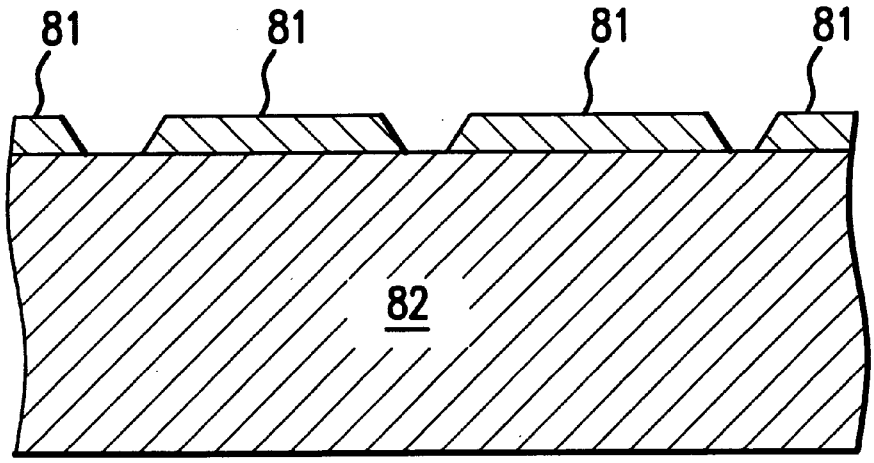
FIG. 8 is a schematic view depicting one example of the mold for embossing the surface of the intermediate transfer medium so that protrusions are dispersed on the smooth part.

As shown in FIG. 8, toner image 81 with no toner present on positions corresponding to the protrusions of the intermediate transfer medium (consequently functioning as recess) is transferred and fixed on recording medium (paper and the like) 82, and by using then the recording medium 82 as an embossing mold, the medium is pressed against the intermediate transfer medium prior to curing (namely, intermediate transfer medium before the rubber or resin is solidified).

Figure 9:
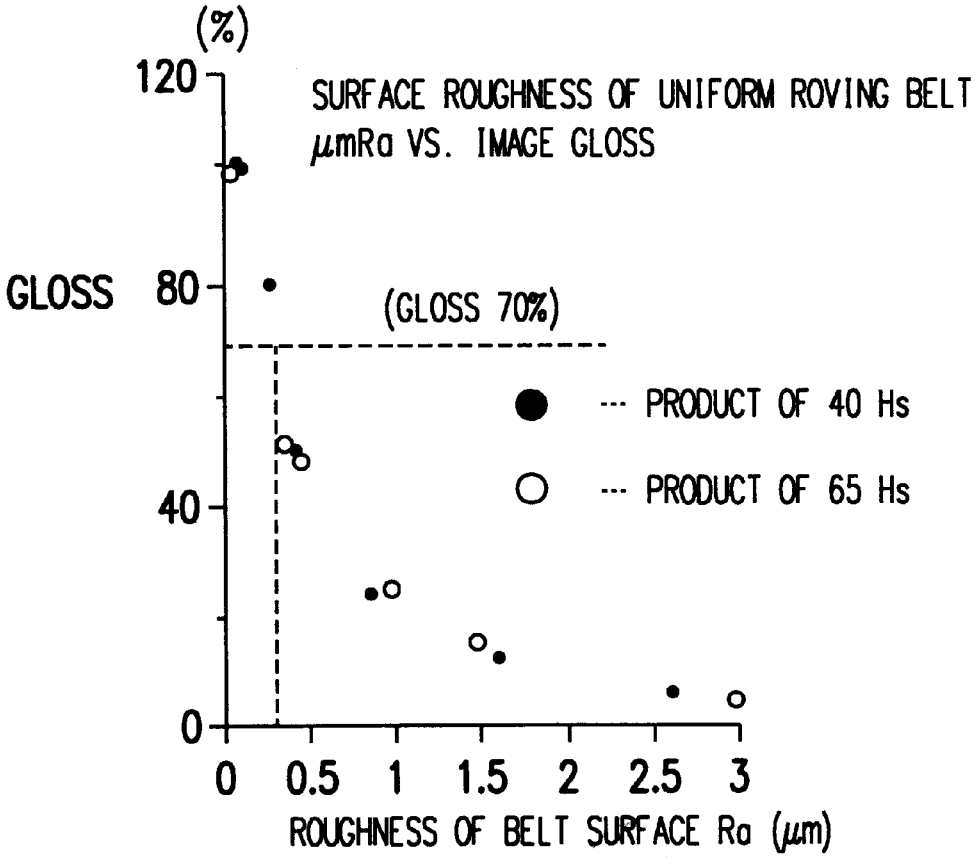
FIG. 9 is a view depicting the relation between the roughness of the surface of the intermediate transfer medium where recesses and protrusions are uniformly prepared and the image gloss.

The interval, depth and size of the recesses are determined by the number of overlaid toners, line number/inch, and the area ratio of the toner image. When protrusions are formed on the surface of the intermediate transfer medium by using a paper mold with one color toner, 200 lines/inch and the area ratio of the toner image being 85%, for example, the height of the protrusions may be modified between 3 $\mu$m to 4 $\mu$m, depending on the conditions for transfer and fixing; the interval may be modified between 100 $\mu$m to 125 $\mu$m; and the area ratio of the smooth surface may be modified between 85% and 90%. The roughness of the smooth part is then 0.10 $\mu$mRa, and therefore, the gloss of the smooth part alone is above 100% as shown in FIG. 9.

The intermediate transfer medium may be of a drum shape, other than the belt shape.

The present invention will be described below in the following examples and control examples. The present invention has been achieved owing to these examples.

In these examples, a 80 $\mu$m-thick polyimide film with addition of carbon black was used as the base layer of an intermediate transfer medium of a belt shape; so as to transfer a toner image from a photoreceptor to the intermediate transfer medium in an electrostatic manner with no image disorder, the volume resistivity of the base layer was adjusted within $10^8$ Ωcm to $10^{12}$ Ωm, by modifying the amount of carbon black to be added.

The surface layer of the intermediate transfer medium was produced by coating silicone rubber of a thickness of 50 $\mu$m (specific materials therefor are described hereinafter) on the base layer.

The amount of each color toner on a recording paper was adjusted to a final content of each pigment of 0.65 mg/cm$^2$.

A system substantially corresponding to the system shown in FIG. 1 was utilized.

As a roll corresponding to the heating and pressing rolls shown in FIG. 1, use was made of an aluminum hollow roll laminated with silicone rubber of hardness of 55 degrees to a final thickness of 3 mm; as a heating source of the inside of the heating roll, use was made of a halogen lamp. Additionally, nip pressure was preset to $5.5\times10^5$ Pa.

CONTROL EXAMPLES

The present inventors have firstly examined the relation between the surface roughness and gloss of the intermediate transfer medium which was uniformly roughed preliminarily. As a method for uniformly roughing the surface of silicone rubber, attempts were made of an embossing method comprising pressing a material with uniform roughness, practically wrapping film (trade name; Imperial Wrapping film, manufactured by Sumitomo 3M), against the surface of silicone rubber (namely, a method for printing out the surface of the wrapping film on the surface of silicone rubber).

More specifically, silicone rubber of rubber hardness of 40 Hs (trade name, Silicone Rubber KE4895, manufactured by Shin-etsu Chemicals, Co. Ltd.) and silicone rubber of rubber hardness of 65 Hs (prototype, manufactured by Toray Dow Corning, Co.) were applied as coating onto the surface of a polyimide belt conductively treated to a final thickness of about 50 $\mu$m, and the wrapping film was placed on the resulting surface prior to crosslinking. After a certain time passed, the film was peeled off, and then, the remaining crosslinking process was carried out. By modifying the gage of the wrapping film and the timing and duration of placing the film on the surface of silicone rubber, then, intermediate transfer mediums with various surface roughness were prepared. Using the intermediate transfer mediums thus prepared by embossing, the relation between image gloss and roughness was examined. The results are shown in FIG. 9.

Systems and the like used for imaging and assessment are specifically described herein.

Copying machine used for the assessment; trade name as Acolor 935, manufactured by Fuji Xerox, Co. Ltd.

Toner; toner for Acolor 935, manufactured by Fuji Xerox, Co. Ltd.

Paper; trade name as J coat paper, manufactured by Fuji Xerox, Co. Ltd.

Gloss meter; Gloss Meter Model GM-26D for 75°, manufactured by Murakami Color Technique Research Institute.

Surface roughness meter; Profile Micrometer VF7500/7510, manufactured by Keyence, Co. Ltd.

FIG. 9 shows that no significant difference is observed in the gloss due to the difference in the hardness of silicone rubber. This may be because the recording paper with a toner image transferred and fixed thereon is peeled off from the intermediate transfer medium after the paper is cooled.

It is said that gloss desirable for color image is as high as 70% or more, and as shown in FIG. 9, the surface roughness should be below Ra 0.3 $\mu$m when the overall surface of the intermediate transfer medium is uniformly roughed.

Figure 10:
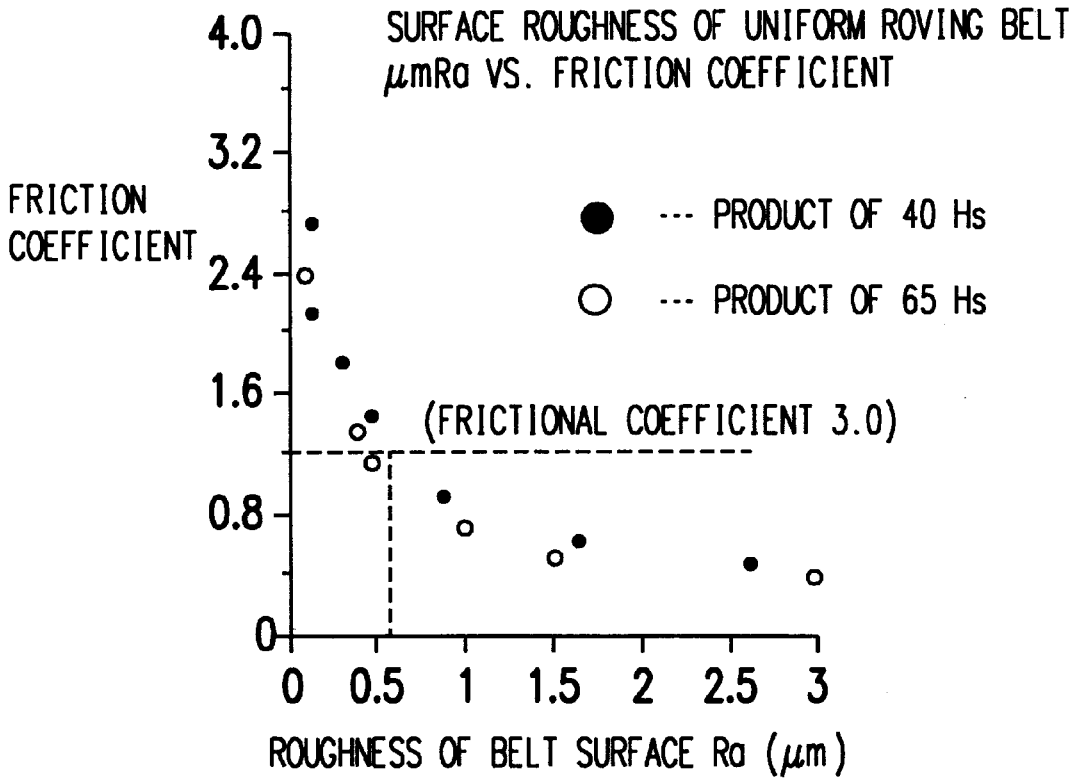
FIG. 10 is a view depicting the relation between the roughness of the surface of the intermediate transfer medium where recesses and protrusions are uniformly prepared and the frictional coefficient.

FIG. 10 shows the frictional coefficient of these embossed intermediate transfer mediums with photoreceptors. Difference is observed in the frictional coefficient due to rubber hardness, and a larger rubber hardness involves a smaller frictional coefficient. This may be because an intermediate transfer medium with a smaller rubber hardness will readily deform under a pressure. A frictional coefficient meter, Peeling/Slipping/Scratching Tester Heidon-14, manufactured by Heidon, Co. Ltd. was used. The rate was 100 mm/sec and the load was 10 gf/mm.

Herein, the permissible range of the frictional coefficient between the intermediate transfer medium and the photoreceptor will be described now.

Figure 11:
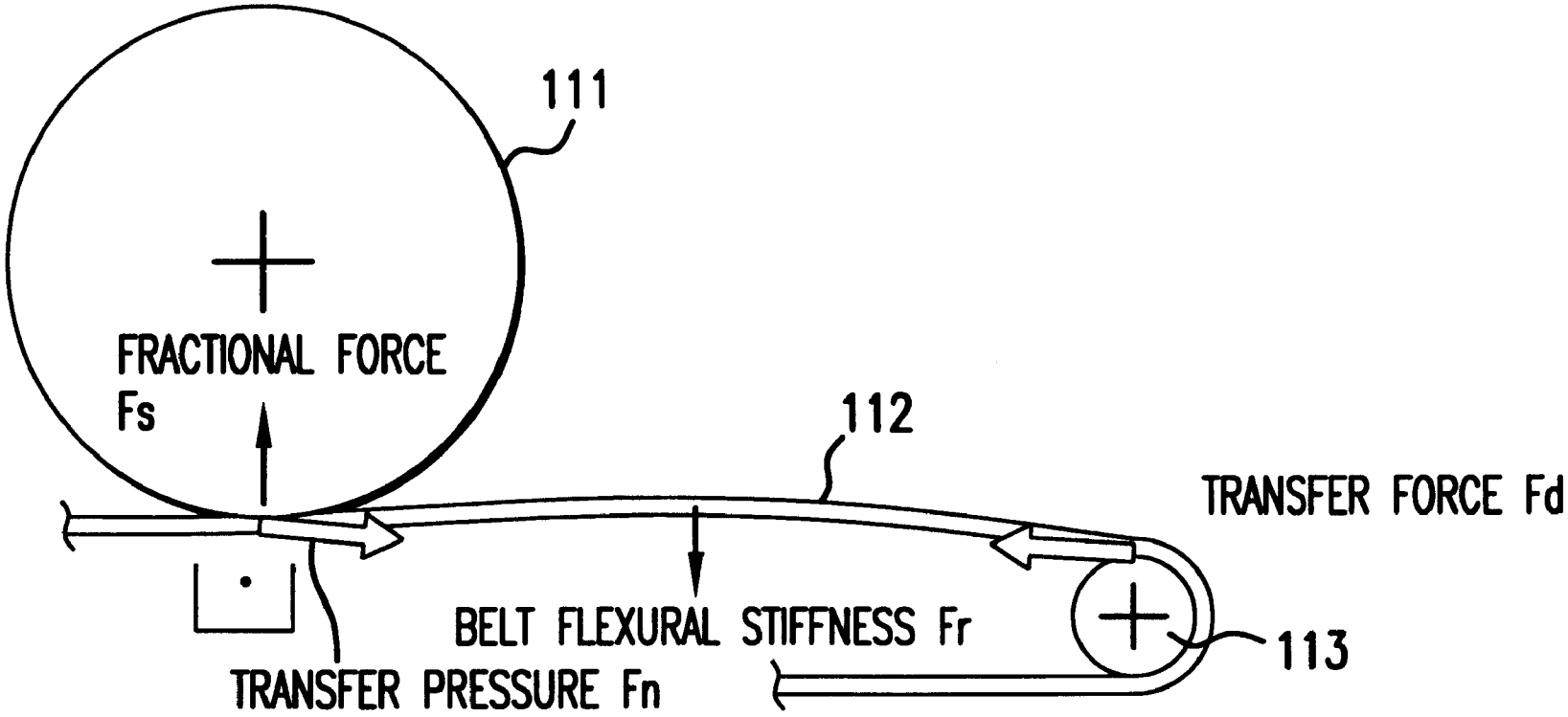
FIG. 11 is a schematic view depicting the relation between the forces working on the intermediate transfer medium and the intermediate transfer medium driving roll to drive the intermediate transfer medium.

FIG. 11 is an explanatory view depicting the relation of the forces working on a photoreceptor 111, intermediate transfer medium belt 112 and intermediate transfer medium driving roll 113 operating the intermediate transfer medium belt 112. The figure shows that because of the precision limit of the mechanical process, the rate of the surface of the photoreceptor 111 eventually differs from the moving rate of the intermediate transfer medium belt 112 and the parallel direction of the photoreceptor 111 and the parallel direction of the driving roll 113 involve an error.

Frictional force Fs defined by frictional coefficient $\mu$ between the photoreceptor 111 and the intermediate transfer medium belt 112 as well as transfer pressure Fn acts between the photoreceptor 111 and the intermediate transfer medium belt 112. Herein, the transfer pressure Fn is the sum of the electrostatic absorption strength involved in transfer and the mechanical plunging power, generally requiring a value of 0.5 g/mm2 at minimum. Between the back face of the intermediate transfer medium belt 112 and the intermediate transfer medium driving roll 113 acts transfer force Fd, to move the intermediate transfer medium belt 112. Alternatively, the intermediate transfer medium belt 112 of itself has flexural stiffness Fr.

If the frictional force Fs is strong compared with the transfer force Fd provided that the belt flexural stiffness Fr is sufficient, slipping occurs between the intermediate transfer medium driving roll 113 and the back face of the intermediate transfer medium belt 112. Consequently, the moving rate of the intermediate transfer medium belt 112 cannot be put under control, whereby the enlargement or shrinking of image or the shift of color overlaying may occur.

When the belt flexural stiffness Fr is insufficient, compared with the frictional force Fs, provided the transfer force Fd is sufficient, the intermediate transfer medium belt 112 waves so that the moving rate of the intermediate transfer medium belt 112 cannot be controlled, whereby the enlargement or shrinking of image or the shift of color overlaying may occur.

Figure 12:
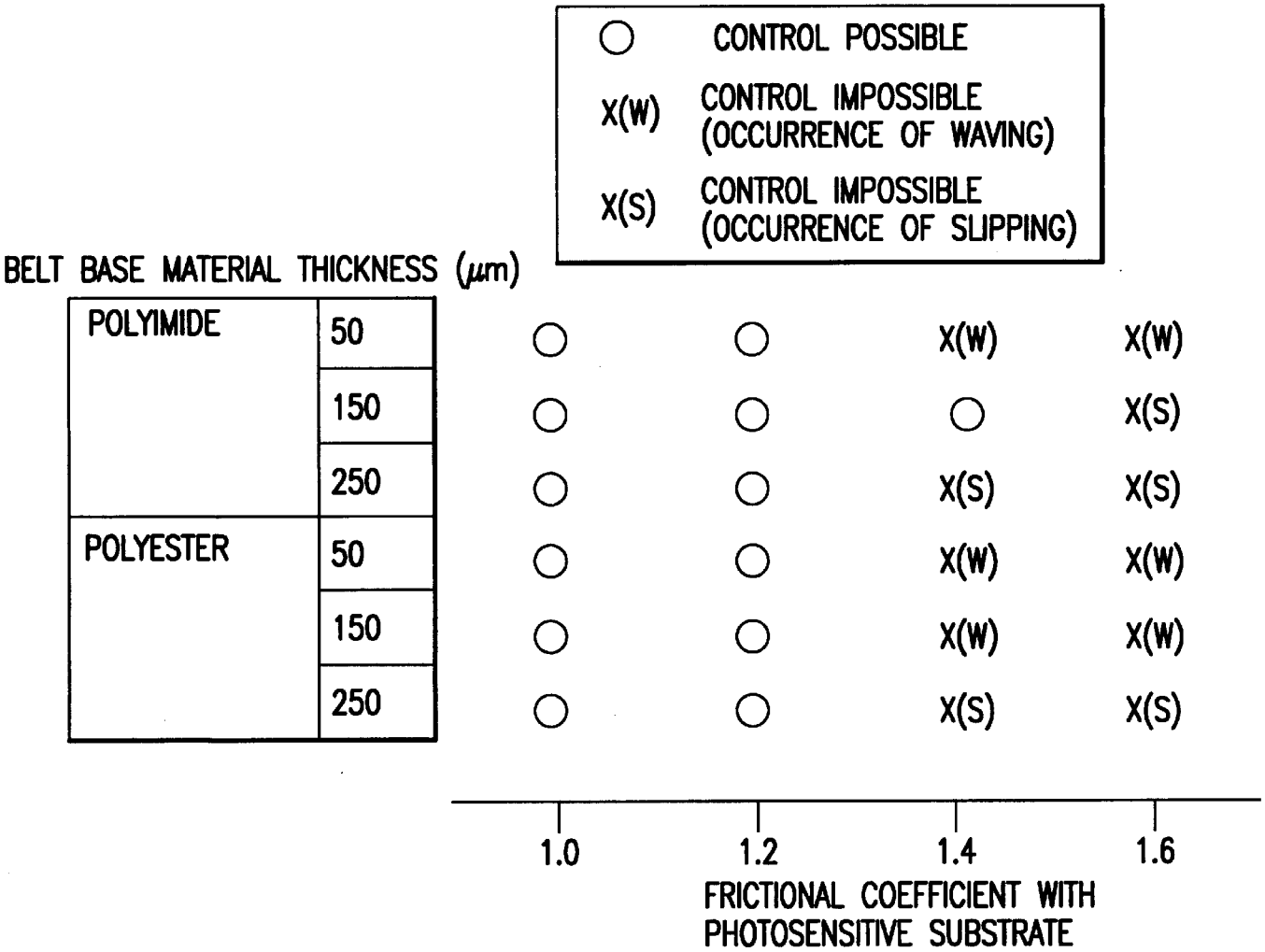
FIG. 12 is a view depicting the relation between the variable frictional coefficients of the intermediate transfer medium with the photoreceptor and the possibility of the control of the running of the intermediate transfer medium.

FIG. 12 shows the presence or absence of such control when the frictional coefficient $\mu$ between the photoreceptor and the intermediate transfer medium (belt) or the belt thickness is modified. The figure indicates that the frictional coefficient has a threshold value, because of the belt waving when the belt is thin with low stiffness and because of the occurrence of slipping of the intermediate transfer medium driving roll when the belt flexural stiffness is increased owing to the belt thickness. In any way, the moving rate cannot be controlled unless the frictional coefficient is 1.2 or less. The results are yielded at transfer pressure Fn of 0.5 g/mm$^2$ at minimum. The frictional coefficient is preferably smaller.

FIG. 10 depicting the frictional coefficient of the embossed intermediate transfer medium with the photoreceptor indicates that the surface roughness of the intermediate transfer medium should be above 0.5 $\mu$mRa so that the frictional coefficient might be below 1.2, provided that the frictional coefficient slightly varies depending on rubber hardness.

Figure 13:
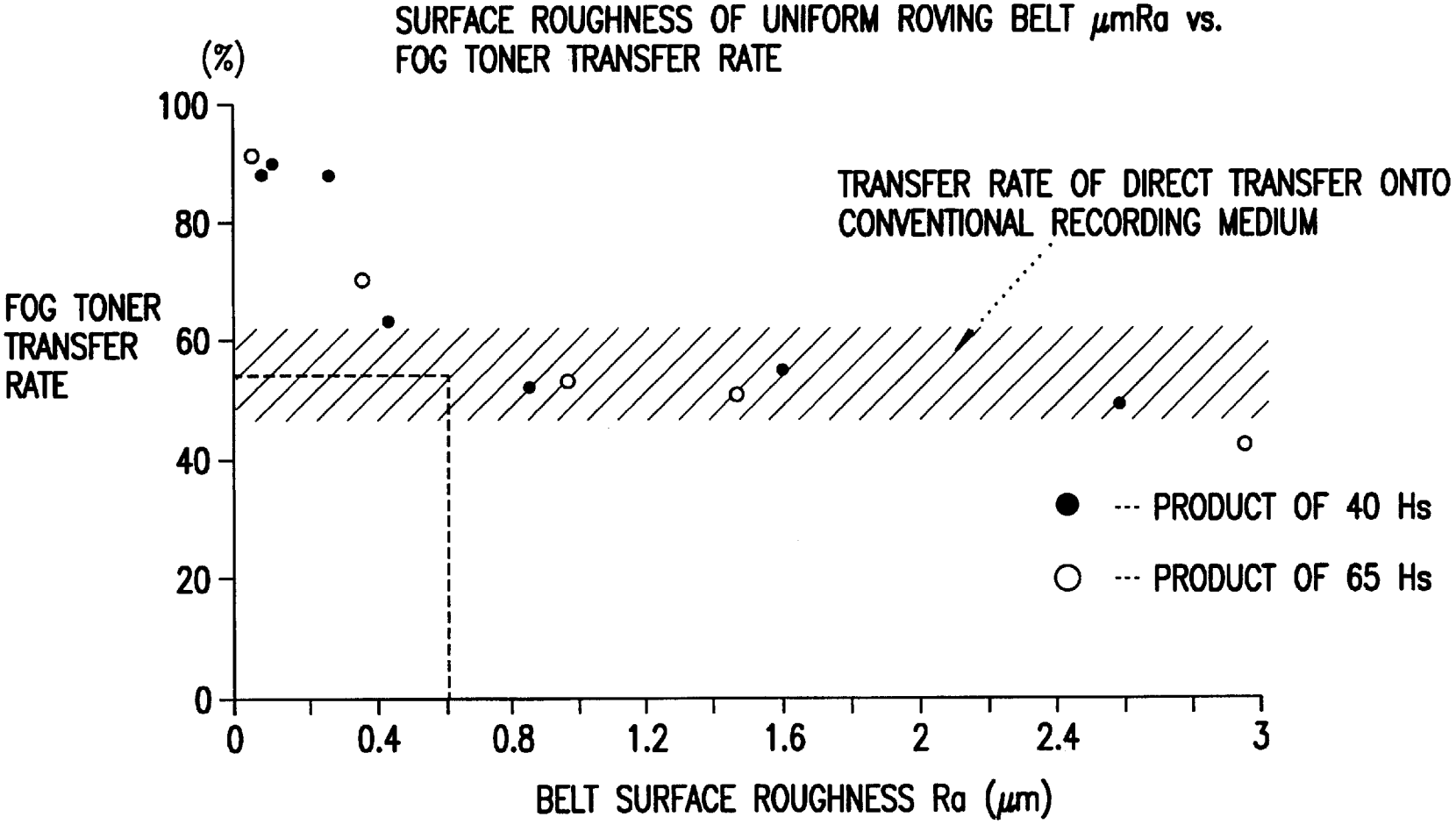
FIG. 13 is a view depicting the relation between the roughness of the surface of the intermediate transfer medium where recesses and protrusions are uniformly prepared and the fog toner transfer rate.

FIG. 13 then depicts the fog toner transfer rate of the embossed intermediate transfer medium. The hatched part in the figure shows the electrostatic transfer rate of the toner image on the photoreceptor to be directly transferred onto a recording medium. So as to gain such transfer rate as conventionally observed, therefore, the surface roughness of the intermediate transfer medium should be above about 0.6 μmRa.

The aforementioned results indicate that an intermediate transfer medium with uniformly rough surface of surface roughness above 0.6 μmRa has a frictional coefficient below 1.2, representing that the fog toner transfer rate then is the same or below the rate by conventional electrostatic transfer, but the medium has a reduced gloss as low as 40% or less.

EXAMPLES

Some Control Examples Inclusive

Based on the results described above, the present inventors have made attempts to rough the surface of the intermediate transfer medium while still leaving smooth surface on the medium, not to uniformly rough the surface. In other words, the inventors have intended to gain a high gloss above 70% by leaving smooth surface with a high gloss at a high area ratio on the surface of the intermediate transfer medium, to reduce the area of the intermediate transfer medium in contact to the surface of the photoreceptor by preparing the remaining part as protrusions except the smooth surface, and to reduce the frictional coefficient and the fog toner transfer rate.

Figure 14:
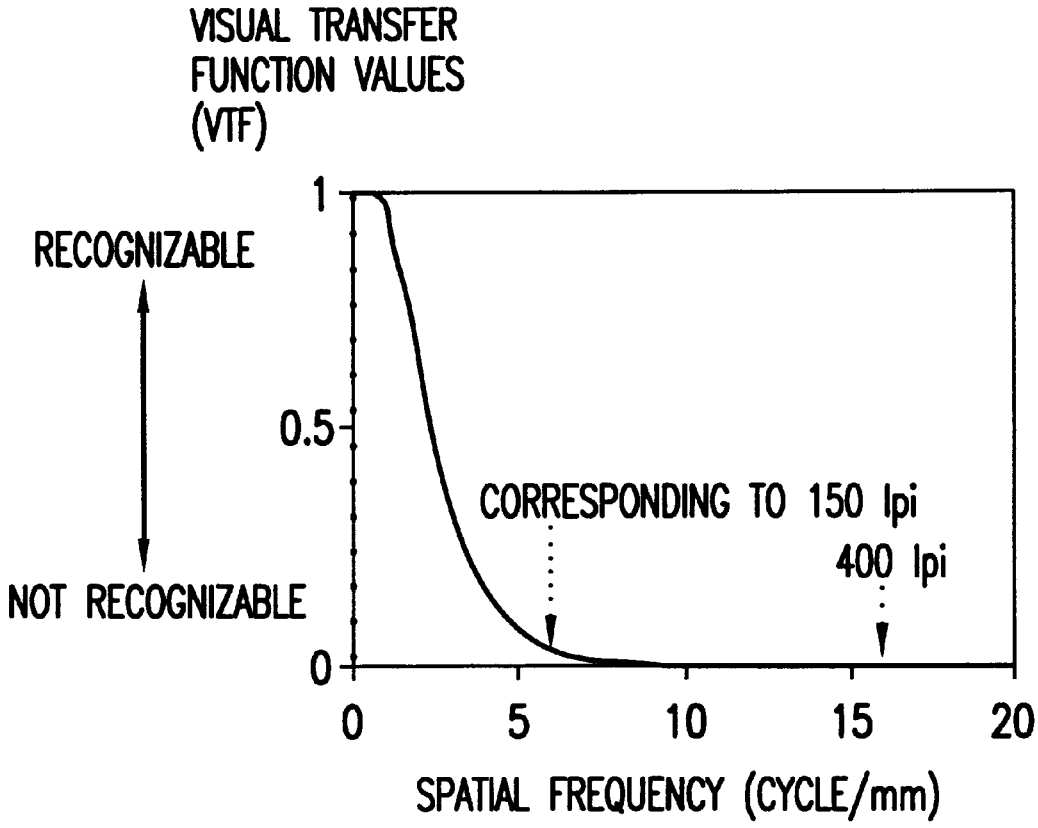
FIG. 14 is a view depicting the relation between spatial frequency and the value of visual transfer function.
Figure 15:
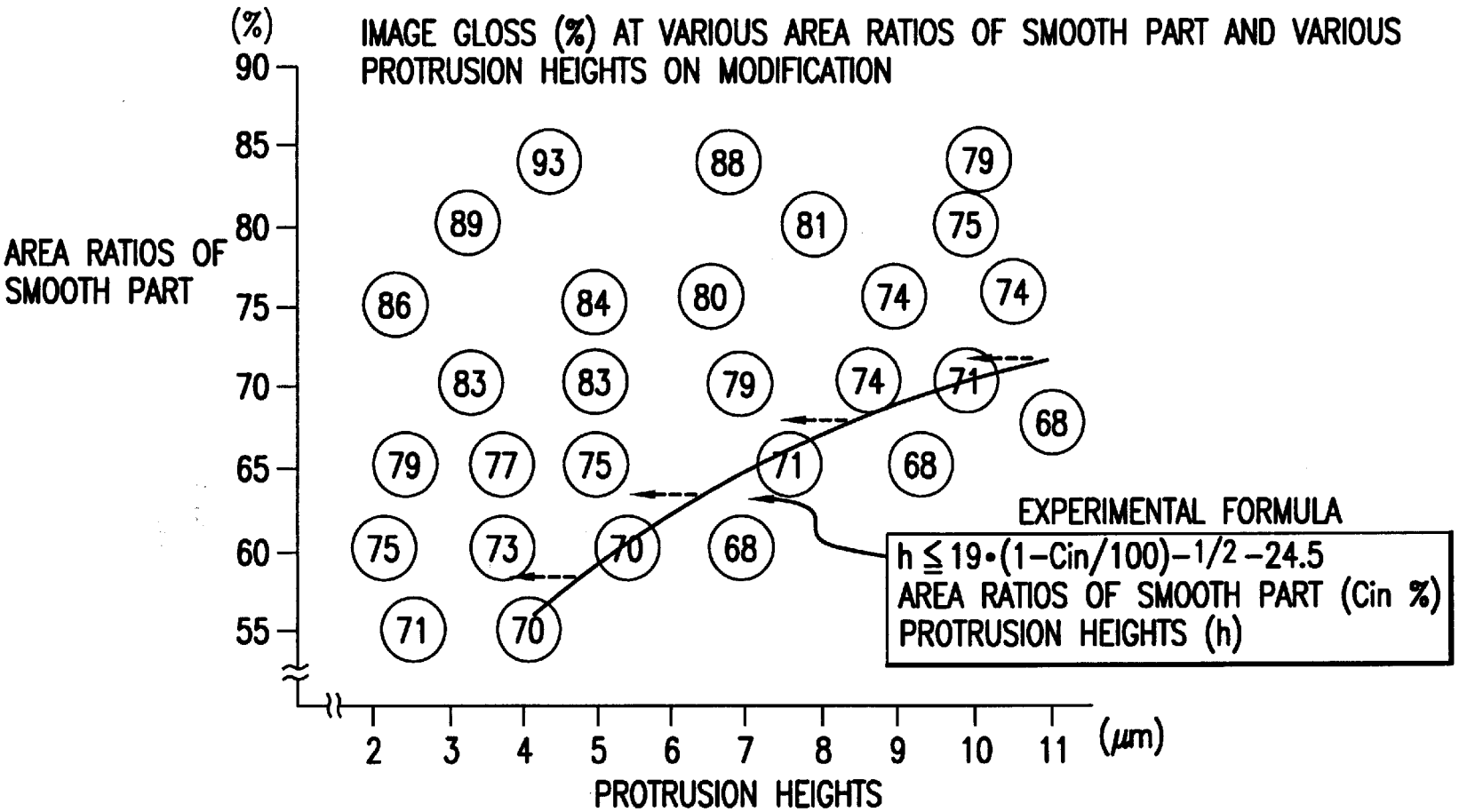
FIG. 15 is a view depicting the relation of the image gloss with the area ratio of the smooth part on the surface of the intermediate transfer medium embossed so that protrusions were dispersed on the smooth part and the height of the protrusions on the surface, when the area ratio and the height were variable.

Herein, it should be considered that on an image of a recording medium, the protrusions on the surface of the intermediate transfer medium form recesses on the surface of the resulting toner image. So as to be non-visual, generally, at least 150 lines/inch or more are necessary according to the visual transfer function (VTF) as shown in FIG. 14. In other words, the interval between the protrusions is 170 μm or less. Functional assessment was made about the negligible interval even if the interval was visually observable. Consequently, it was found that the interval might satisfactorily be about 200 μm. Therefore, assessment was made about practically possible area of the smooth part so as to gain an image gloss above 70%, by modifying the height of the protrusions. The results are shown in FIG. 15. Practically, the results were yielded as follows; an intermediate transfer medium coated with silicone rubber of rubber hardness of 40 Hs was firstly prepared, by using a recording paper with the toner image as a model, and by subsequently modifying the area of the smooth part and the height of the protrusions, the toner image was transferred and fixed on a recording paper, to measure the gloss.

So as to recover a desirably high gloss for color image, the relation between the height of the protrusions and the area ratio of the smooth part should be represented above the solid line in FIG. 15.

The relation between the area ratio of the smooth surface and the height of the protrusions should satisfy the following experimental area ratio as shown in formula (1):

$$h \leqq 19 \cdot (1-\mathrm{Cin}/100)^{-1/2} - 24.5 \quad (1):$$

the height of the protrusions being in unit μm; Cin in unit %.

For example, satisfactorily, the area ratio (Cin) of the smooth part is above 85%; and the height of the protrusions (h) is about 10 μm or less.

Because of the conditions for preparing an embossing mold for the surface of the intermediate transfer medium, the interval of the protrusions cannot vary greatly, but the interval within a range of 120 μm to 200 μm is not so significant for the relation between the area ratio of the smooth part and the height of the protrusions.

Figure 16:
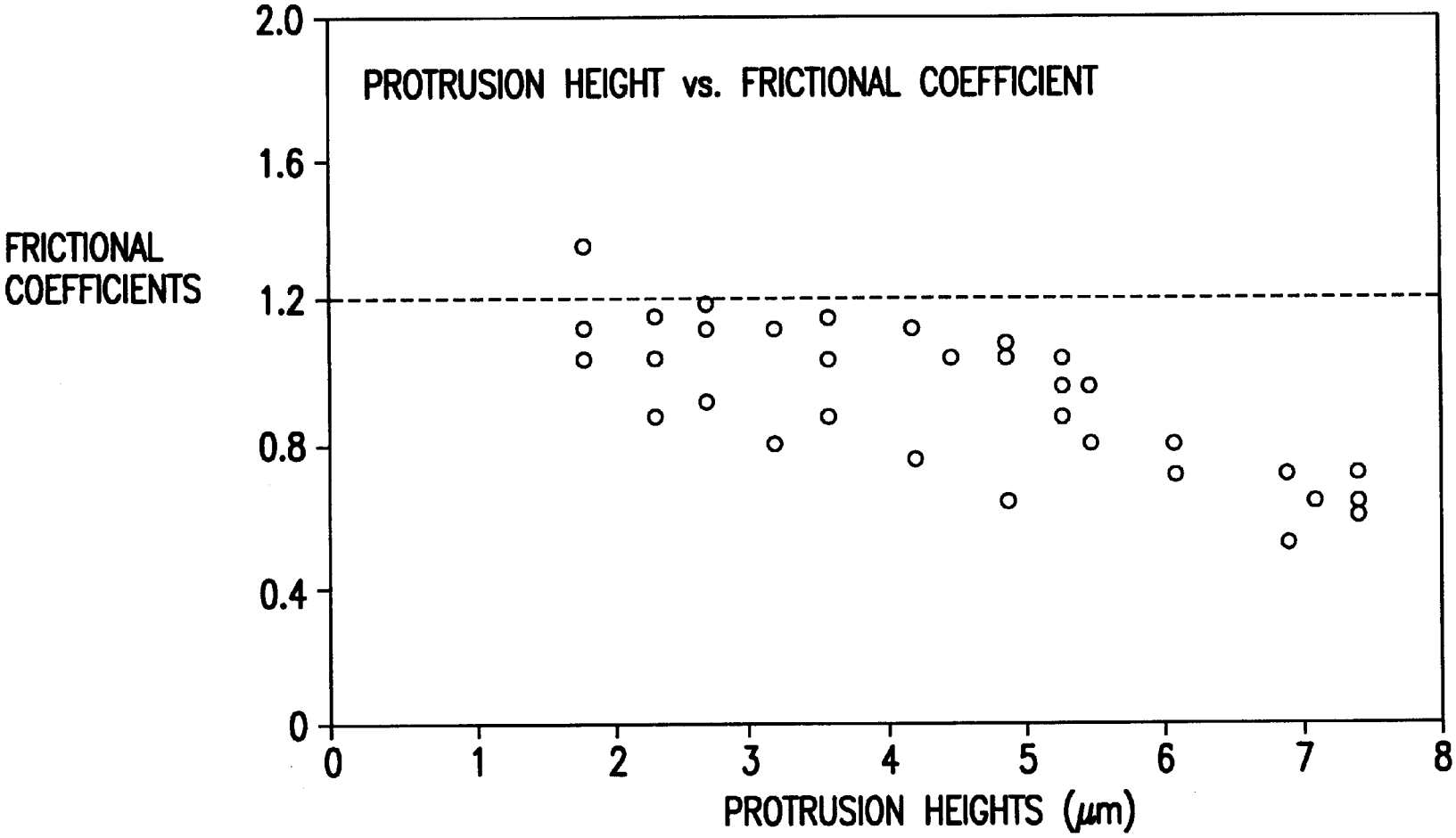
FIG. 16 is a view depicting the relation between the height of the protrusions on the surface of the intermediate transfer medium embossed so that protrusions were dispersed on the smooth part and the frictional coefficient.
Figure 17:
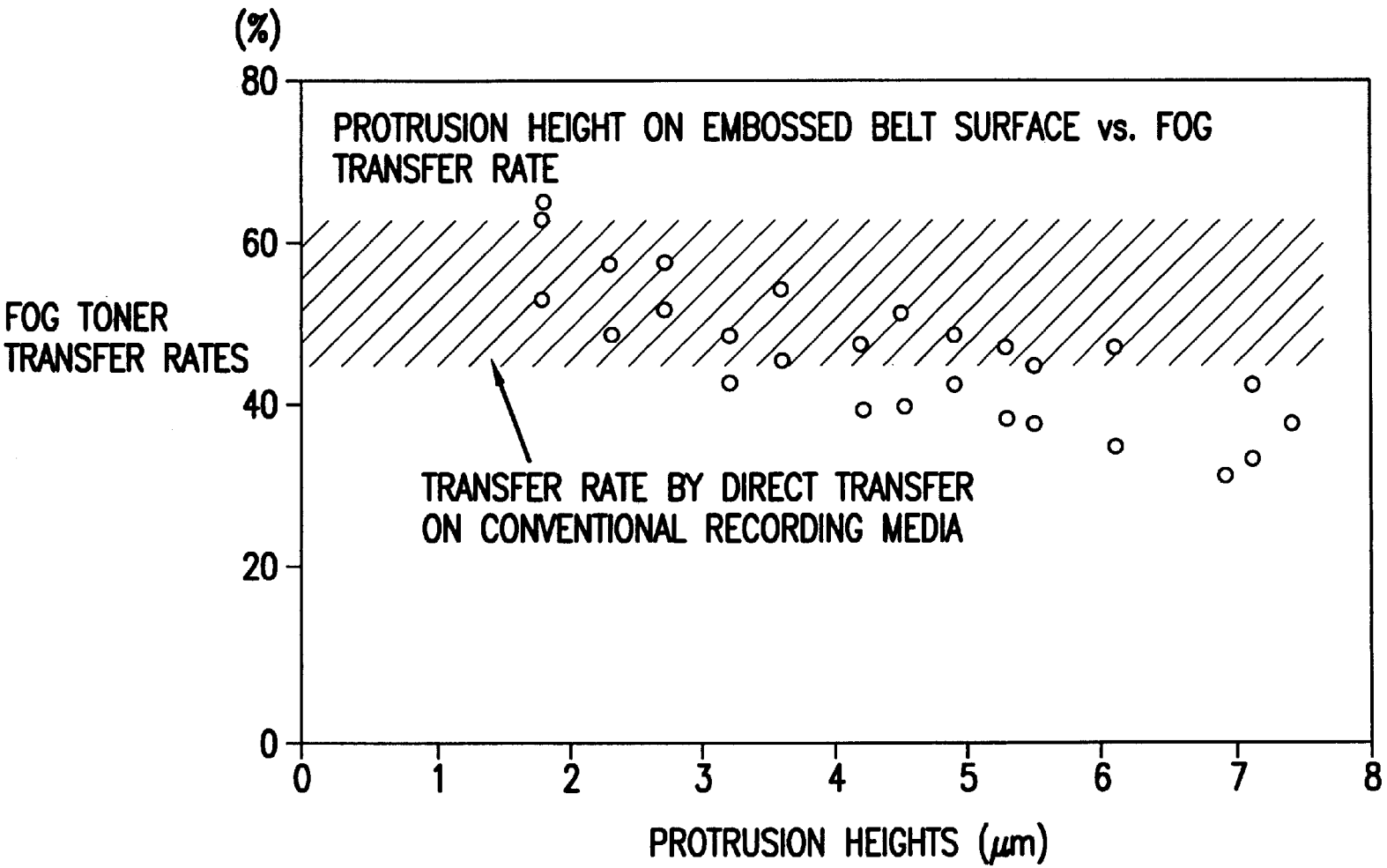
FIG. 17 is a view depicting the relation between the height of the protrusions on the surface of the intermediate transfer medium embossed so that protrusions were dispersed on the smooth part and the fog toner transfer rate.

FIGS. 16 and 17 show the results of the determination of the frictional coefficient with the photoreceptor and the fog toner transfer rate, as additional two requirements. The frictional coefficient with the photoreceptor and the fog toner transfer rate were determined by using intermediate transfer mediums with the surfaces of silicone rubber types of 40 Hs and 65 Hs, having the smooth surface area ratio within a range of 55% to 95% and the protrusions of various heights.

FIG. 16 indicates that the frictional coefficient is 1.2 or less if the height of the protrusions is 2 μm or above, provided that the smooth surface area ratio is within a range of 55% to 95%, although the frictional coefficient with the photoreceptor essentially depends on the smooth surface area ratio.

The smooth surface area ratio of 0.55 or more means the area ratio of the protrusions below 0.45. Because the contact area is about 1/3, the frictional coefficient should be reduced simply as about 1/3-fold the coefficient of the smooth surface. However, practically, the frictional coefficient is not reduced so simply, because of the possible deformation of the silicone rubber. From the respect of the driving run control of the intermediate transfer medium, the frictional coefficient is required to be 1.2 or less, but the present experiments indicate that the height of the protrusions may satisfactorily be 2 μm or more even if taking account of the variation of the smooth surface area ratio.

The experimental results also indicate that the fog toner transfer rate is not so influenced by the smooth surface area ratio provided that the protrusions are present at some extent; that the transfer rate can be decreased to the same level as or lower than the transfer rate of direct transfer onto a recording medium by conventional electrostatic power, as long as the height of the protrusions is above 2 μm. The average particle size of the color toner presently used is about 7 μm, and therefore, the color toner is brought into contact with the smooth part in the recesses. Nevertheless, the fog toner transfer rate is reduced, because the adhesion of the fog toner to the photoreceptor is sometimes larger than the adhesion thereof to the surface of the intermediate transfer medium due to the reduction of the pressure from the smooth part of the intermediate transfer medium toward the fog toner. Consequently, the overall fog toner transfer rate is possibly decreased.

For reducing the frictional coefficient of the intermediate transfer medium with the photoreceptor (below 1.2 in the present example), the aforementioned results indicate that the area ratio of smooth parts arranged on the silicone rubber on the surface of the intermediate transfer medium and the height of protrusions above 2 μm being arranged on the smooth parts should be determined so that these satisfy the formula (1), whereby the resulting image can procure a high gloss and the fog toner transfer rate can be the same as or smaller than the fog toner transfer rate by conventional direct electrostatic transfer on a recording medium.

The gloss desirable for color image is defined as 70%, but if the gloss of 60% is permissible, the area ratio of the smooth part and the height of the protrusions should be determined on the basis of the relation between the area ratio of the smooth part and the height of the protrusions in FIG. 15.

The present invention is not limited to the aforementioned examples, and the present invention should be defined on the basis of the gist and scope of the invention.

According to the present invention, imaging comprising transferring and fixing a toner image from a photoreceptor onto a recording medium by using an intermediate transfer medium can gain a high gloss desirable for color image and through the process, the driving run of the intermediate transfer medium can be controlled well for preventing image shift. Additionally, the fog toner transfer rate onto the photoreceptor can be reduced as the same level as or lower than the level by direct transfer on a recording medium by conventional electrostatic power.

What is claimed is:

1. An intermediate transfer medium to be used for an image forming method comprising the steps of developing a photoreceptor with an electrostatic latent image formed thereon in a developer containing toner, primarily transferring the developed toner image onto the intermediate transfer medium, and thereafter putting the primarily transferred toner image in contact to a recording medium to transfer the toner image onto the recording medium at least by heating, the intermediate transfer medium comprising a surface with the toner image primarily transferred thereon, which is of smooth surface with protrusions dispersed thereon in a manner such that the smooth surface and the protrusions might be discriminated from each other, wherein the relation between the area ratio of the smooth surface on the surface of the intermediate transfer medium where the image is primarily transferred (Cin %) and the height of the protrusions (h ($\mu$m)) satisfies the following experimental formula (1):

$$h \leqq 19 \cdot (1-\mathrm{Cin}/100)^{-1/2} - 24.5 \quad (1).$$

2. An intermediate transfer medium according to claim 1, wherein the protrusions have a height of 2 $\mu$m or more to 12 $\mu$m or less.

3. An intermediate transfer medium according to claim 2, wherein the protrusions have an interval of 10 $\mu$m or more to 200 $\mu$or less.

4. An intermediate transfer medium according to claim 1, wherein the Cin is 50 to 95%.

5. An intermediate transfer medium according to claim 4, wherein the surface with the image primarily transferred thereon has a gloss of 60% or more.

6. An intermediate transfer medium according to claim 5, wherein the gloss of the surface with the image primarily transferred thereon is 70% or more.

7. An intermediate transfer medium according to claim 1, wherein the surface with the toner image primarily transferred thereon comprises silicone rubber.

8. An intermediate transfer medium to be used for an imaging method comprising the steps of developing a photoreceptor with an electrostatic latent image formed thereon in a developer containing toner, primarily transferring the developed toner image onto the intermediate transfer medium, and thereafter putting the primarily transferred toner image brought into contact with a recording medium to transfer the toner image onto the recording medium at least by heating, the intermediate transfer medium comprising:

a surface with the toner image primarily transferred thereon having a smooth surface with protrusions dispersed thereon in a manner such that the smooth surface and the protrusions might be discriminated from each other;

the relation between the area ratio of the smooth surface on the surface of the intermediate transfer medium where the image is primarily transferred [Cin %] and the height of the protrusions [h ($\mu$m)] satisfies the following experimental formula (1):

$$h \leqq 19 \cdot (1-\mathrm{Cin}/100)^{-1/2} - 24.5 \quad (1);$$

the protrusions having a height of 2 $\mu$m or more.

9. An intermediate transfer medium according to claim 8, wherein the Cin is 50 to 95%.

10. An image forming device at least comprising a photoreceptor, a developing unit to supply a developer containing toner to the photoreceptor, an intermediate transfer medium brought into contact with the photoreceptor, recording medium transport means to transport a recording medium to the intermediate transfer medium to bring the recording medium into contact with the intermediate transfer medium, and heating means to heat a contact part, the image forming device being capable of practicing an image forming method comprising the steps of forming an electrostatic latent image on a photoreceptor by using light, developing the electrostatic latent image by a developer containing toner, primarily transferring the developed toner image on the intermediate transfer medium, subsequently bringing the primarily transferred toner image into contact with the recording medium, and transferring the toner image onto the recording medium at least by heating, the image forming device comprising:

a surface of the intermediate transfer medium where the image is primarily transferred being a smooth surface with protrusions dispersed thereon in a manner such that the smooth surface and the protrusions might be discriminated from each other, wherein the relation between the area ratio of the smooth surface on the surface of the intermediate transfer medium where the image is primarily transferred (Cin %) and the height of the protrusions (h ($\mu$m)) satisfies the following experimental formula (1):

$$h \leqq 19 \cdot (1-\mathrm{Cin}/100)^{-1/2} - 24.5 \quad (1).$$

11. A method for producing an intermediate transfer medium according to claim 1, comprising a process of pressing a mold with a face corresponding to the surface where the image is primarily transferred against the surface of the intermediate transfer medium, prior to final curing.

12. A method for producing an intermediate transfer medium according to claim 11, wherein the mold is composed of a recording medium and the toner image transferred on the surface thereof.

* * * * *